US010405601B2

(12) United States Patent
Kuefler et al.

(10) Patent No.: US 10,405,601 B2
(45) Date of Patent: Sep. 10, 2019

(54) CYCLING SHOE

(71) Applicant: Trek Bicycle Corporation, Waterloo, WI (US)

(72) Inventors: Thomas Kuefler, Cambridge, WI (US); Kyle Russ, Madison, WI (US)

(73) Assignee: Trek Bicycle Corporation, Waterloo, WI (US)

( * ) Notice: Subject to any disclaimer, the term of this patent is extended or adjusted under 35 U.S.C. 154(b) by 0 days.

(21) Appl. No.: 15/697,590

(22) Filed: Sep. 7, 2017

(65) Prior Publication Data

US 2019/0069626 A1 Mar. 7, 2019

(51) Int. Cl.

| | |
|---|---|
| ***A43B 5/14*** | (2006.01) |
| *A43C 15/02* | (2006.01) |
| *A43B 13/14* | (2006.01) |

(52) U.S. Cl.

CPC ..... *A43B 5/14* (2013.01); *A43B 13/141* (2013.01); *A43C 15/02* (2013.01)

(58) Field of Classification Search

CPC ..... A43B 5/14; A43C 11/14; A43C 11/146; A43C 11/1493

USPC ..... 36/131

See application file for complete search history.

(56) References Cited

U.S. PATENT DOCUMENTS

| | | | | |
|---|---|---|---|---|
| 6,477,793 | B1 * | 11/2002 | Pruitt | A43B 5/14 36/103 |
| 2003/0093924 | A1 * | 5/2003 | Delgorgue | A43B 1/0072 36/117.3 |
| 2006/0010716 | A1 * | 1/2006 | Kerns | A43B 5/14 36/25 R |
| 2007/0043630 | A1 * | 2/2007 | Lyden | A43B 1/0081 705/26.41 |
| 2009/0293318 | A1 * | 12/2009 | Garneau | A43B 5/14 36/131 |
| 2009/0320329 | A1 * | 12/2009 | Darby, II | A43B 7/00 36/140 |
| 2011/0113648 | A1 * | 5/2011 | Leick | A43B 1/0081 36/50.1 |
| 2016/0044988 | A1 * | 2/2016 | Delgorgue | A43C 15/16 36/131 |

* cited by examiner

*Primary Examiner* — Ted Kavanaugh
(74) *Attorney, Agent, or Firm* — Bell & Manning, LLC

(57) ABSTRACT

A cycling shoe includes a sole, a heel counter mounted to the sole, and a toe cap mounted to the sole. The cycling shoe also includes a forefoot strap that includes a medial forefoot strap and a lateral forefoot strap. The medial forefoot strap includes a first portion mounted to the toe cap and a second portion mounted to the sole such that a first metatarsal head relief window is formed between the first portion and the second portion. The lateral forefoot strap is mounted to the sole such that a fifth metatarsal head relief window is formed between a distal edge of the lateral forefoot strap and the toe cap.

20 Claims, 7 Drawing Sheets

CYCLING SHOE

BACKGROUND

A cycling shoe is a type of shoe that is designed specifically for bicycling. Compared to traditional tennis shoes, a cycling shoe is typically lighter and more rigid to provide an efficient transfer of power from the cyclist to the bicycle pedals. Traditional cycling shoes include a slotted shoe plate or cleat on the sole attaches to bicycle pedals via a toe clip and toe strap system incorporated into the pedals. Modern cycling shoes typically include a cleat on the sole that is designed to temporarily connect to a fitting on the pedal without the use of traditional toe clips and straps.

SUMMARY

An illustrative cycling shoe includes a sole, a heel counter mounted to the sole, and a toe cap mounted to the sole. The cycling shoe also includes a forefoot strap that includes a medial forefoot strap and a lateral forefoot strap. The medial forefoot strap includes a first portion mounted to the toe cap and a second portion mounted to the sole such that a first metatarsal head relief window is formed between the first portion and the second portion. The lateral forefoot strap is mounted to the sole such that a fifth metatarsal head relief window is formed between a distal edge of the lateral forefoot strap and the toe cap.

An illustrative method for constructing a cycling shoe includes mounting a heel counter to a sole. The method also includes mounting a toe cap to the sole. The method further includes mounting a forefoot strap that includes a medial forefoot strap and a lateral forefoot strap to the cycling shoe. Mounting the forefoot strap includes mounting a first portion of the medial forefoot strap to the toe cap and mounting a second portion of the medial forefoot strap to the sole to form a first metatarsal head relief window between the first portion of the medial forefoot strap and the second portion of the medial forefoot strap. Mounting the forefoot strap also includes mounting the lateral forefoot strap to the sole to form a fifth metatarsal head relief window between a distal edge of the lateral forefoot strap and the toe cap.

Other principal features and advantages of the invention will become apparent to those skilled in the art upon review of the following drawings, the detailed description, and the appended claims.

BRIEF DESCRIPTION OF THE DRAWINGS

Illustrative embodiments will hereafter be described with reference to the accompanying drawings, wherein like numerals denote like elements. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Traditional cycling shoes squeeze the metatarsal bones of the foot together when the foot is secured by the closure system, which can be regular shoe laces, Velcro®, a ratchet dial lacing system such as the Boa®, etc. This squeezing causes pain and numbness in the foot due to the compression of the dorsal and plantar nerves. Described herein are cycling shoes that provide enhanced comfort and bone relief as compared to traditional cycling shoe by reducing lateral compression (or squeezing) of the metatarsal bones, and therefore the compression of the nerves of the foot in this region. The enhanced comfort and bone relief are provided in part through strategically placed, flexible support straps to secure the shoes to a user's foot in a way that provides relief to at least the user's first and fifth metatarsal heads and the fifth metatarsal tuberosity. In addition, multi-directional flexible material can be used to improve the comfort, breathability, and stability of the shoes.

Figure 1:
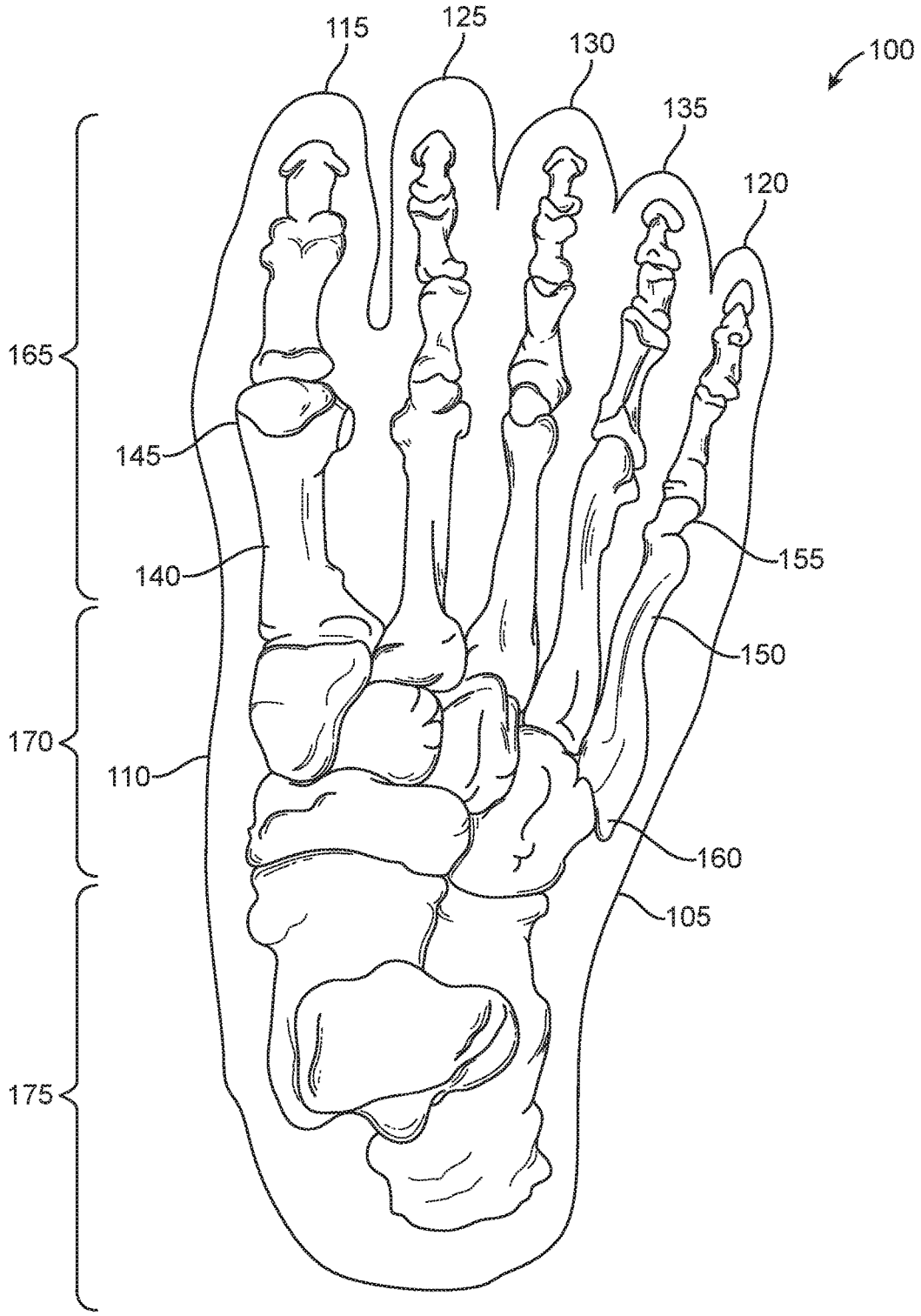
FIG. 1 is a top view of a right human foot in accordance with an illustrative embodiment.

FIG. 1 is a top view of a right human foot 100 in accordance with an illustrative embodiment. The foot 100 includes a lateral (or outer) side 105 and a medial (or inner) side 110. Adjacent to the medial side 110 of the foot 100 is a first toe 115, and adjacent to the lateral side 105 of the foot 100 is a fifth toe 120. The foot 100 also includes a second toe 125, a third toe 130, and a fourth toe 135. Among other bones, the first toe 115 includes a first metatarsal 140, which has a first metatarsal head 145. Similarly, the fifth toe 120 includes a fifth metatarsal 150. The fifth metatarsal 150 has a fifth metatarsal head 155 and a fifth metatarsal tuberosity 160. A most distal portion of the foot 100 is referred to as a forefoot 165, a central portion of the foot 100 is referred to as a midfoot 170, and a portion of the foot that includes the heel is referred to as a hindfoot 175. As used herein, distal refers to a direction toward the toes (or the forefoot 165) of the foot 100 and proximal refers to a direction toward the heel (or the hindfoot 175) of the foot 100.

Figure 2:
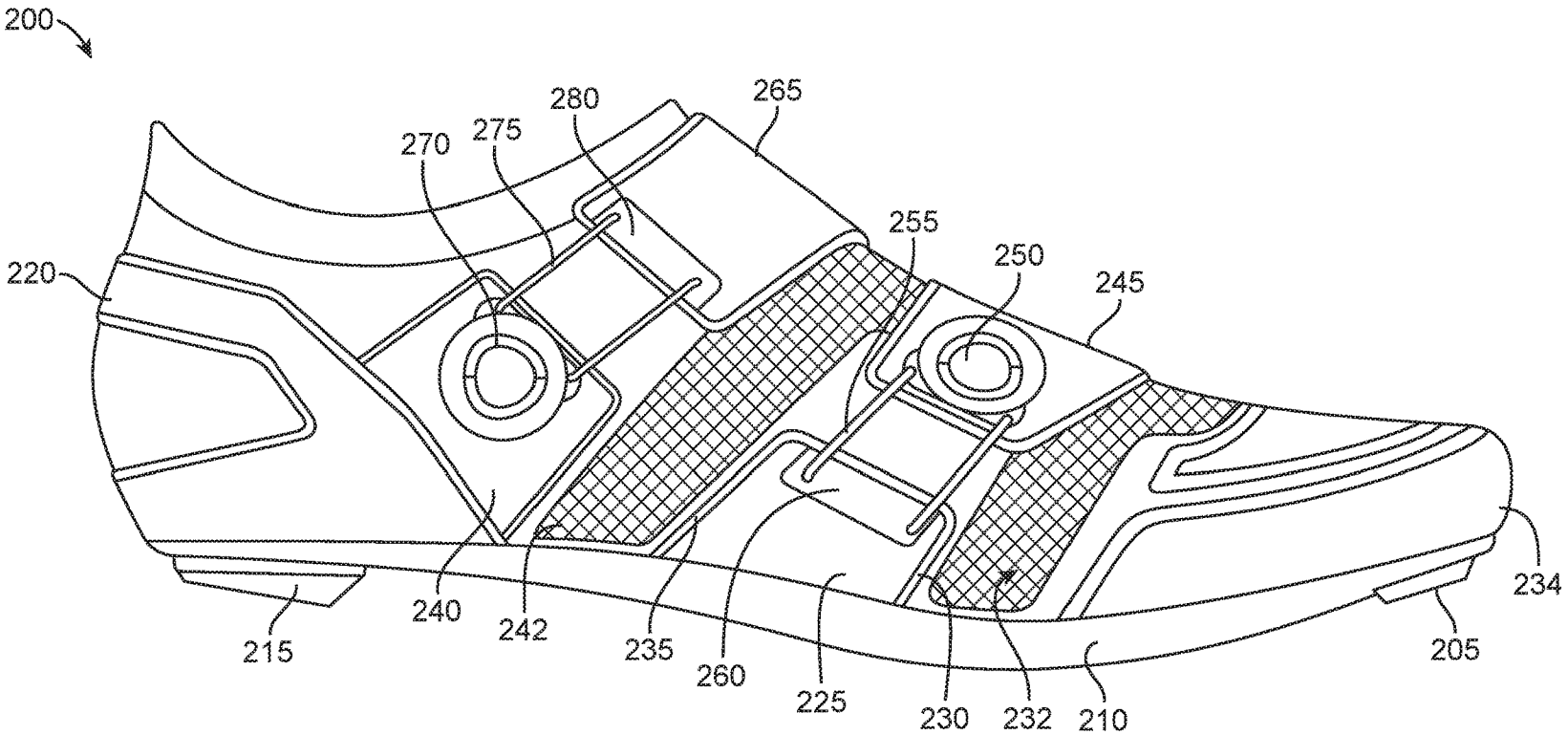
FIG. 2 depicts a lateral side of a cycling shoe in accordance with an illustrative embodiment.

FIG. 2 depicts a lateral side of a cycling shoe 200 in accordance with an illustrative embodiment. The lateral side of the cycling shoe 200 is configured to conform to the lateral side 105 of the foot 100 depicted in FIG. 1. The cycling shoe 200 includes a toe stud 205 that is configured to project the sole during a toe-off portion of a user's walking gait. The cycling shoe 200 also includes a sole 210, a heel stud 215 mounted to the sole 210, a heel counter 220, and a toe cap 234. The sole 210 can be made at least in part from a carbon fiber material. In an illustrative embodiment, the heel counter 220 and toe cap 234 are semi-rigid structures that can be made at least in part from a plastic material. Alternatively, the heel counter 220 and the toe cap 234 may be made from a different material such as carbon fiber. The toe stud 205 and the heel stud 215 can be mounted to the sole 210 using standard techniques known to those of skill in the art. The heel counter 220 and/or the toe cap 234 can be internal to the cycling shoe 200 such that they are covered with material. Alternatively, the heel counter 220 and/or the toe cap 234 can be external such that they are mounted on the outside of the body of the cycling shoe 200. The heel counter 220 and toe cap 234 can be mounted to the sole 210 via an adhesive, stitching, or any other method. In another alternative embodiment, the cycling shoe 200 may not include the heel counter 220 and/or the toe cap 234. In such an embodiment, the heel counter 220 and/or the toe cap 234 may be replaced with one of the stretch materials described herein.

As depicted, the lateral side of the cycling shoe 200 also includes a lateral forefoot strap 225 that is anchored to the sole 210. The lateral forefoot strap 225 can be mounted to the sole 210 by stitching, adhesive, or any other method. The lateral forefoot strap 225 is positioned such that a distal edge 230 of the lateral forefoot strap 225 is proximal to the fifth metatarsal head of a user's foot, and such that a proximal edge 235 of the lateral forefoot strap 225 is distal to the fifth metatarsal tuberosity of the user's foot. This positioning of the lateral forefoot strap 225 is used to reduce pressure imposed on the fifth metatarsal head when the cycling shoe 200 is tightened, resulting in a more comfortable shoe that is less likely to cause foot pain for the user. More specifically, a space (or window) 232 between the distal edge 230 of the lateral forefoot strap 225 and the toe cap 234 of the cycling shoe 200 creates a window of relief for the user's fifth metatarsal head when the lateral forefoot strap 225 is tightened. As a result, the user's fifth metatarsal head is not painfully compressed when the lateral forefoot strap 225 is tightened. In an illustrative embodiment, the material that fills the space 232 is flexible and breathable.

The lateral side of the cycling shoe 200 also includes a lateral midfoot strap 240 which is mounted to the heel counter 220. The lateral midfoot strap 225 can be mounted to the heel counter 220 by stitching, adhesive, or any other method. Mounting the lateral midfoot strap 240 to the heel counter 220 results in a downward and backward pull orientation when the lateral midfoot strap 240 is tightened. This mounting provides support and containment of the user's instep and heel. In an alternative embodiment, the lateral midfoot strap 240 may be mounted directly to the sole 210. A space (or window) 242 between the lateral midfoot strap 240 and the proximal edge 235 of the lateral forefoot strap 225 creates a window of relief for the user's fifth metatarsal tuberosity. As a result, the user's fifth metatarsal tuberosity is not painfully compressed when the lateral forefoot strap 225 and the lateral midfoot strap 240 are tightened. In an illustrative embodiment, the material that fills the space 242 is flexible and breathable.

The lateral forefoot strap 225 is connected to a medial forefoot strap 245 via a first securing system, and the lateral forefoot strap 225 and the medial forefoot strap 245 combine to form a forefoot strap for the cycling shoe 200. The medial forefoot strap 245 is described in more detail with reference to FIG. 3. The first securing system includes a dial 250 mounted to the medial forefoot strap 245, a lace 255, and a lace guide 260 mounted to the lateral forefoot strap 225. A user can turn the dial 250 to tighten or loosen the lace 255, thereby controlling the tightness of the lateral forefoot strap 225 and the medial forefoot strap 245 on the user's foot. In an alternative embodiment, a different type of first securing system may be used such as Velcro® straps or standard laces. In another alternative embodiment, the components of the first securing system may be reversed such that the dial 250 is positioned on the lateral forefoot strap 225 and the lace guide 260 is positioned on the medial forefoot strap 245.

Similarly, the lateral midfoot strap 240 is connected to a medial midfoot strap 265 via a second securing system, and the lateral midfoot strap 240 and the medial midfoot strap 265 combine to form a midfoot strap for the cycling shoe 200. The medial midfoot strap 265 is described in more detail with reference to FIG. 3. The second securing system includes a dial 270 mounted to the lateral midfoot strap 240, a lace 275, and a lace guide 280 mounted to the medial midfoot strap 265. The user can turn the dial 270 to tighten or loosen the lace 275, which controls the tightness of the lateral midfoot strap 240 and the medial midfoot strap 265 on the user's foot. In an alternative embodiment, a different type of second securing system may be used such as Velcro® straps or standard laces. In another alternative embodiment, the components of the second securing system may be reversed such that the dial 270 is positioned on the medial midfoot strap 265 and the lace guide 280 is positioned on the lateral midfoot strap 240.

Figure 3:
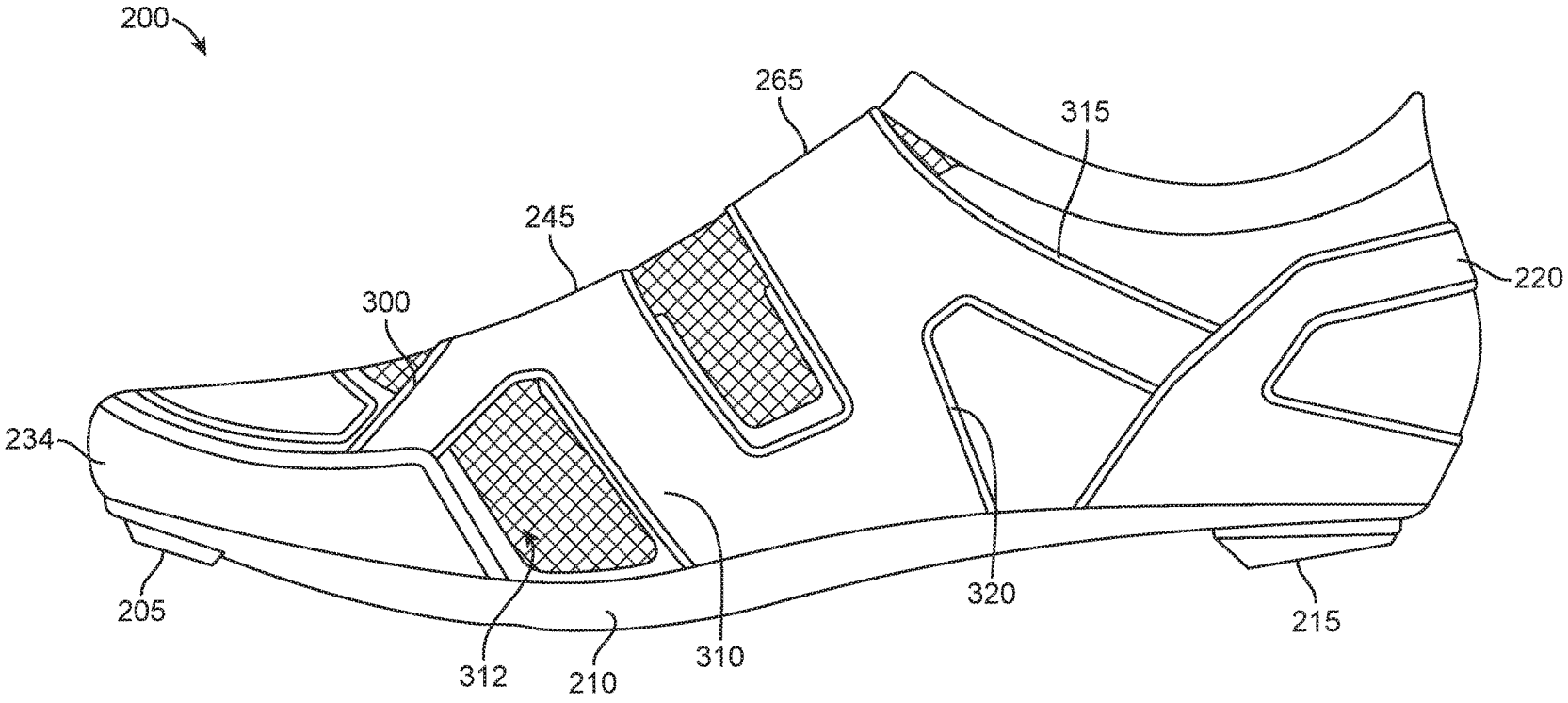
FIG. 3 depicts a medial side of the cycling shoe of FIG. 2 in accordance with an illustrative embodiment.

FIG. 3 depicts a medial side of the cycling shoe 200 of FIG. 2 in accordance with an illustrative embodiment. As indicated in FIG. 3, the medial forefoot strap 245 has two anchoring locations. A first portion 300 of the medial forefoot strap 245 is anchored to the toe cap 234 of the cycling shoe 200 such that the first portion 300 is distal to a first metatarsal head of the user. Such an anchoring location reduces pressure on the first metatarsal head, resulting in a more comfortable experience for the user. The first portion 300 of the medial forefoot strap 245 is also anchored to the toe cap 234 such that it is superior to (i.e., above) the first toe of the user, which helps to prevent squeezing and/or rubbing of the first toe when the medial forefoot strap 245 is tightened. In an embodiment in which the toe cap 234 is not present, the first portion 300 of the medial forefoot strap 245 may be mounted directly to the stretch material which forms a body of the shoe, and which is described in more detail below.

A second portion 310 of the medial forefoot strap 245 is mounted to the sole 210 such that the second portion 310 is proximal to the first metatarsal head, which reduces pressure on the first metatarsal head and creates a more comfortable experience for the user. Mounting the second portion 310 to the sole 210 also provides additional support and containment of the forefoot. The space (or window) 312 between the mounting location of the first portion 300 of the medial forefoot strap 245 and the second portion 310 of the medial forefoot strap 245 creates a window of relief for the first metatarsal head.

The medial midfoot strap 265 also includes a first portion 315 and a second portion 320. The first portion 315 of the medial midfoot strap 265 is mounted to the heel counter 220, which provides support and containment of the user's instep and heel. Anchoring to the heel counter 220 also results in a downward and backward pull orientation when the medial midfoot strap 265 is tightened. In an alternative embodiment, the first portion 315 of the medial midfoot strap 265 may be mounted to the sole 210.

Figure 7:
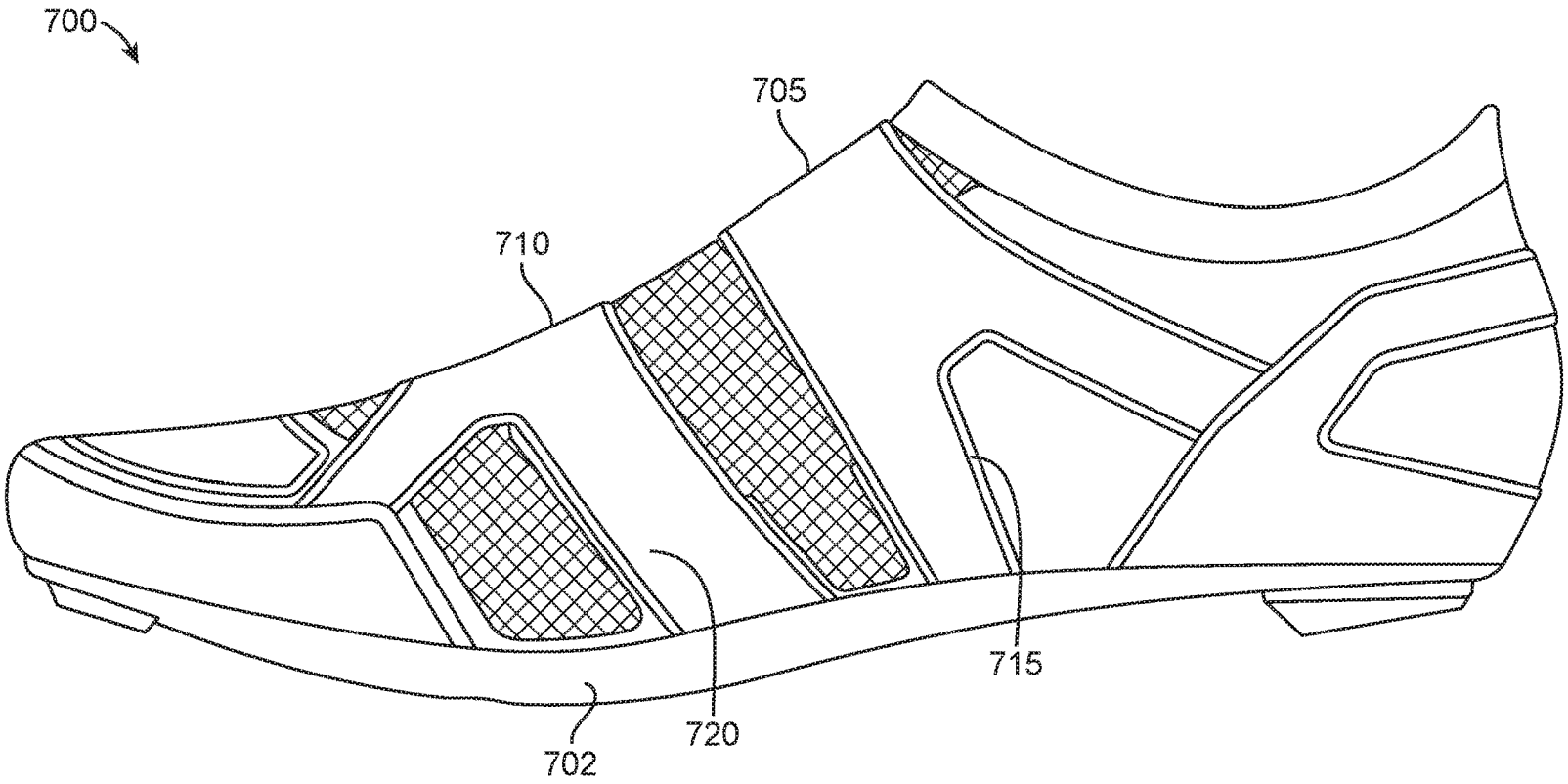
FIG. 7 depicts a medial side of a cycling shoe with independent medial straps in accordance with an illustrative embodiment.

The second portion 320 of the medial midfoot strap 265 is anchored to the sole 210 such that the second portion 320 is distal to the heel of the user. Such mounting provides support and containment of the user's instep, supports the medial arch of the user's foot, and helps draw the user's foot down and back into the heel counter 220 of the cycling shoe 200. As depicted in FIG. 3, the second portion 320 of the medial midfoot strap 265 is connected to the second portion 310 of the medial forefoot strap 245, and both the second portion 320 and the second portion 310 are mounted to the sole 210. In an alternative embodiment, the second portion 310 and the second portion 320 may not be connected to one another, and may be independently mounted to the sole 210. For example, FIG. 7 depicts a medial side of a cycling shoe 700 with independent medial straps in accordance with an illustrative embodiment. In FIG. 7, the cycling shoe 700 includes a sole 702, a medial midfoot strap 705, and a medial forefoot strap 710. As depicted, a second portion 715 of the medial midfoot strap 705 is mounted to the sole 702 independent of a second portion 720 of the medial forefoot strap 710, which is also mounted to the sole 702. A lateral side of the cycling shoe 700 (not shown) can be similar or identical to the lateral side of the cycling shoe 200 depicted in FIG. 2.

Figure 4:
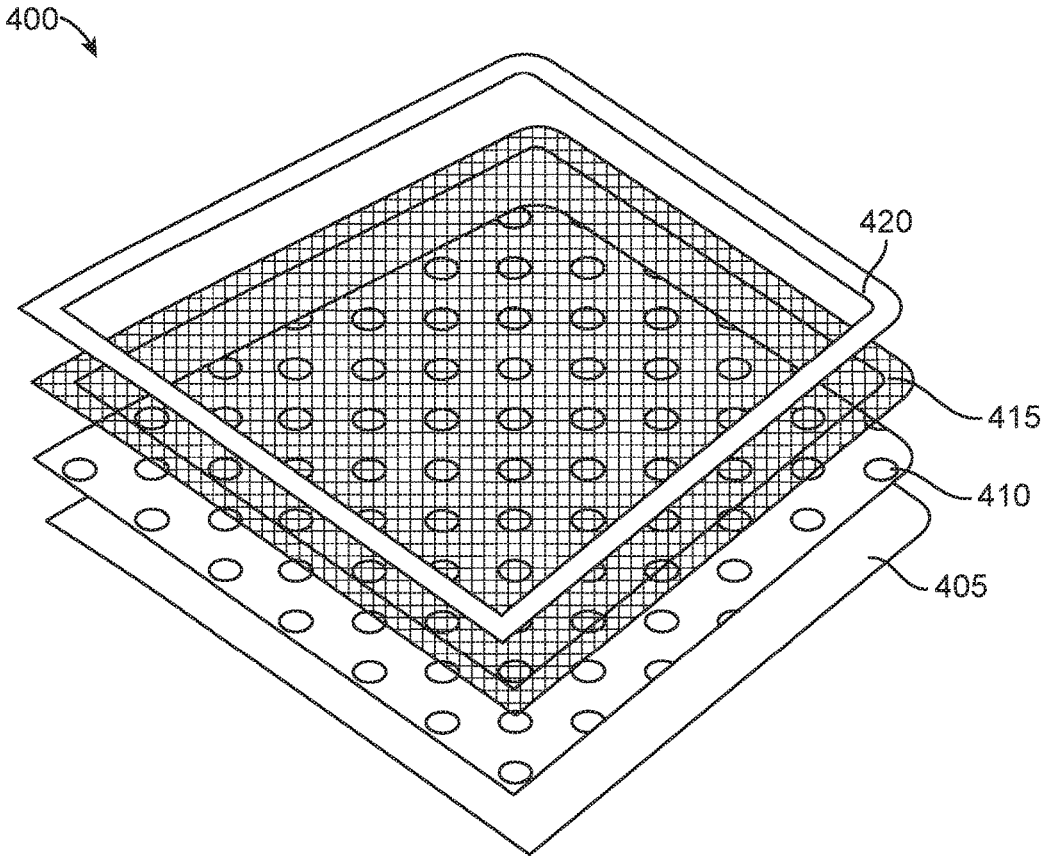
FIG. 4 depicts layers in a portion of a strap for a cycling shoe in accordance with an illustrative embodiment.

FIG. 4 depicts layers in a portion of a strap 400 for a cycling shoe in accordance with an illustrative embodiment. The depicted layers can be used to construct any of the straps described herein. A first layer 405 of the portion of the strap 400 is composed of a durable, non-stretch backing liner material. The first layer 405 can be a bottommost layer of the strap which is closest to the user's foot when the strap is secured. A second layer 410, which is adjacent to the first layer 405, is a perforated neoprene foam material. The second layer 410 of perforated neoprene foam provides a cushion such that the strap does not dig in to the top of the user's foot when tightened. A third layer 415, which is adjacent to the second layer 410, is composed of a 2-way stretch net mesh material. The third layer 415 provides the straps with some flexibility and also breathability. A fourth layer 420, which is a topmost layer of the portion of the strap 400 and adjacent to the third layer 415, is composed of a thermoplastic polyurethane (tpu) film. The fourth layer 420 in combination with the first layer 405 provide structural support for the straps. In an alternative embodiment, the strap 400 can be composed of fewer or additional layers of material. In another alternative embodiment, different types of material may be used for the layers of the strap 400.

Figure 5:
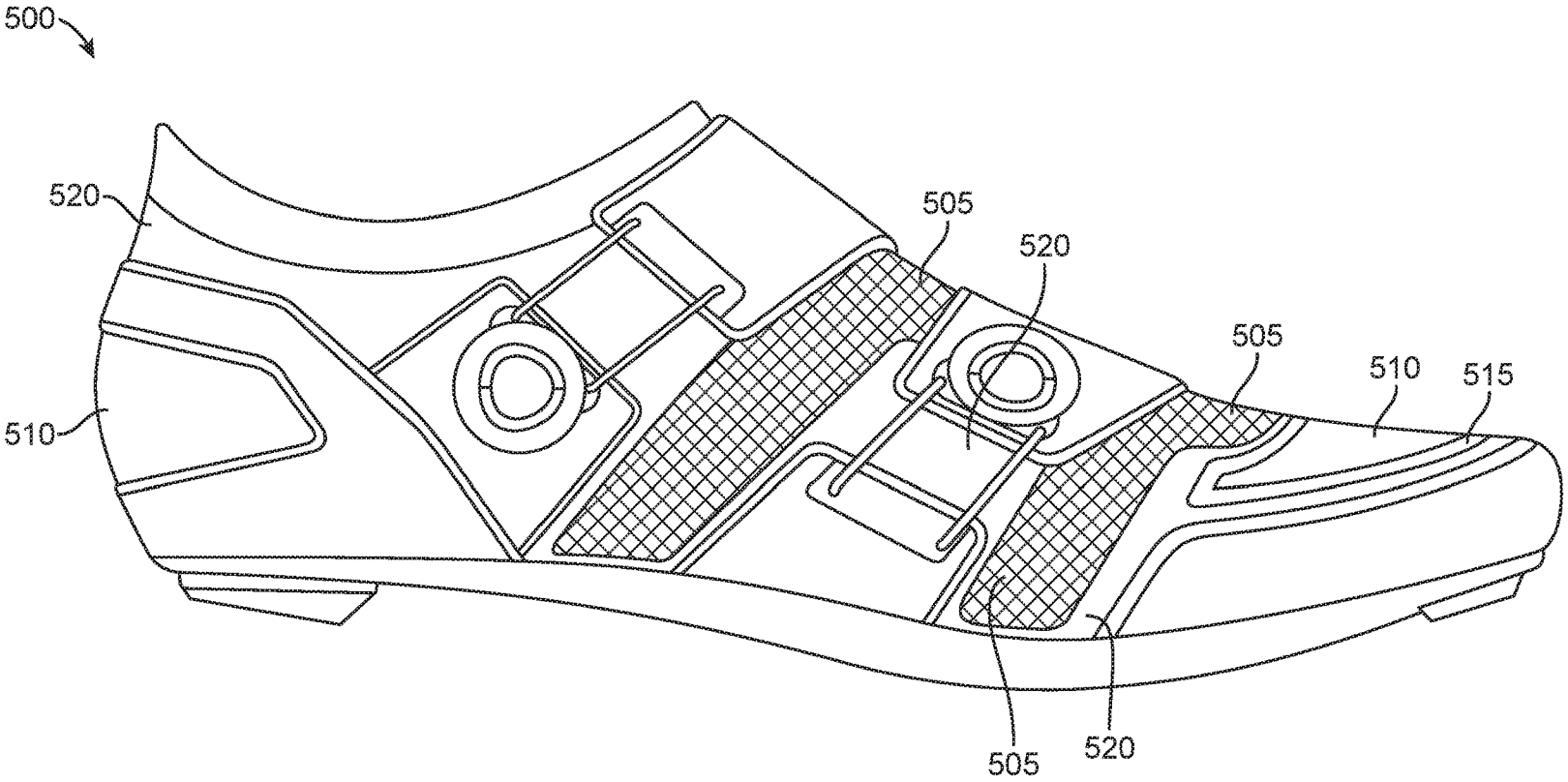
FIG. 5 depicts the knit configuration on a lateral side of a cycling shoe in accordance with an illustrative embodiment.
Figure 6:
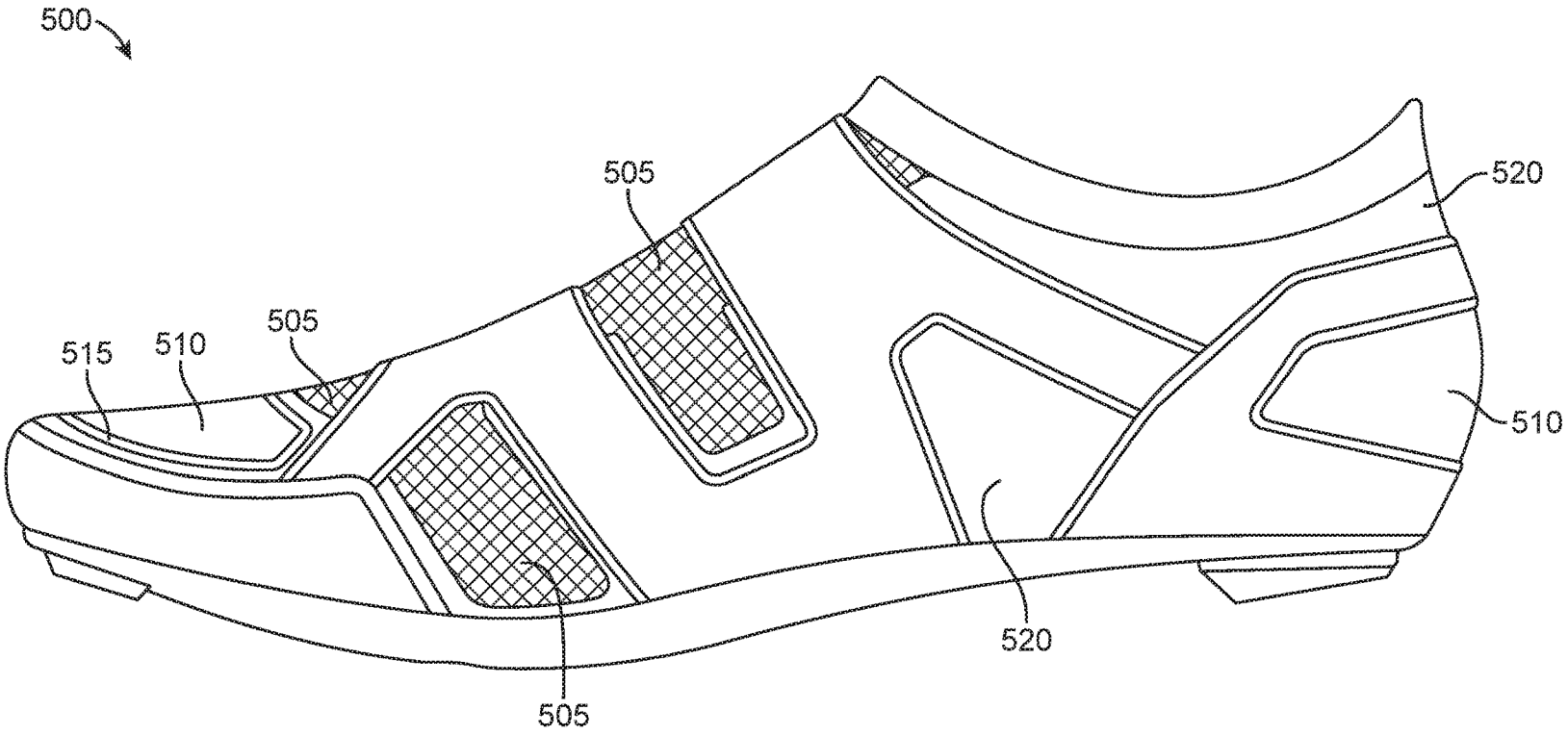
FIG. 6 depicts the knit configuration on a medial side of the cycling shoe of FIG. 5 in accordance with an illustrative embodiment.

In an illustrative embodiment, a body of the cycling shoe 200 depicted in FIGS. 2-3 is composed of a stretch material. In one embodiment, different types of stretch material can be used in different areas of the shoe to provide different amounts of structural support, flexibility, and breathability. In an illustrative embodiment, the stretch material can be a knit mesh material that is knitted using a polyester thread or yarn. Alternatively, the stretch material can be any other type of elastic or semi-elastic material such as neoprene, spandex, cotton, lycra, etc. FIGS. 5 and 6 depict an illustrative stretch material arrangement for the cycling shoes described herein. Specifically, FIG. 5 depicts the stretch material configuration on a lateral side of a cycling shoe 500 in accordance with an illustrative embodiment. FIG. 6 depicts the stretch material configuration on a medial side of the cycling shoe 500 of FIG. 5 in accordance with an illustrative embodiment. Unlike many traditional shoes, the cycling shoe 500 does not include a separate tongue formed in an opening on the top of the shoe. Rather, the cycling shoe 500 is a uni-body construction made of various types of stretch material, as described below.

With reference to FIGS. 5 and 6, it can be seen that various portions of the cycling shoe 500 include a first stretch material 505, various portions include a second stretch material 510, various portions include a third stretch material 515, and various portions include a fourth stretch material 520. The first stretch material 505 has a greater amount of stretch than that of the second stretch material 510, the third stretch material 515, and the fourth stretch material 520. In an embodiment in which the stretch materials are knit mesh, the first stretch material 505 includes a large scale knit patterning with openings that are larger than those of the second stretch material 510, third stretch material 515, and fourth stretch material 520. In an embodiment in which the stretch materials are not knit mesh, the first stretch material 505 can be designed to have the most stretch (of the four stretch materials) using any material fabrication techniques known to those of skill in the art. The first stretch material 505 therefore provides good stretch/flexibility to the areas of the cycling shoe 500 in which it is present.

In the lateral side view of FIG. 5, it can be seen that the first stretch material 505 is used in the relief windows formed by the straps, namely the relief window for the fifth metatarsal head formed between the toe cap and the distal edge of the lateral forefoot strap and the relief window for the fifth metatarsal tuberosity formed between the lateral midfoot strap and the proximal edge of the lateral forefoot strap. The use of the flexible first stretch material 505 in these areas further helps to prevent compression of the fifth metatarsal and fifth metatarsal tuberosity. The first stretch material 505 is also used on a top portion of the cycling shoe 500 that rests on the top of a user's foot.

In an embodiment in which the stretch materials are knit mesh, the second stretch material 510 can be formed from a medium scale knit patterning that has openings which are smaller than the openings in the first stretch material 505. In an embodiment in which the stretch materials are not knit mesh, the second stretch material 510 can be designed to have the second most stretch (of the four stretch materials) using any material fabrication techniques known to those of skill in the art. The second stretch material 510 therefore provides some stretch/flexibility, but not as much as the first stretch material 505. As indicated in the figures, the second stretch material 510 is used in an opening in the heel counter and to cover a portion of the top of the toe cap.

In an embodiment in which the stretch materials are knit mesh, the third stretch material 515 can be formed from a small scale knit patterning that has openings which are smaller than the openings in the second stretch material 510. In an embodiment in which the stretch materials are not knit mesh, the third stretch material 515 can be designed to have the third most stretch (of the four stretch materials) using any material fabrication techniques known to those of skill in the art. As a result, the third stretch material 515 has more limited flexibility as compared to the first stretch material 505 and the second stretch material 510. The third stretch material 515 is used on top of the toe cap and surrounds a portion of the cycling shoe 500 composed of the second stretch material 510.

In an embodiment in which the stretch materials are knit mesh, the fourth stretch material 520 can be formed from an extra small scale knit patterning that has openings which are smaller than the openings in the third stretch material 515. In an embodiment in which the stretch materials are not knit mesh, the fourth stretch material 520 can be designed to have the least stretch (of the four stretch materials) using any material fabrication techniques known to those of skill in the art. The fourth stretch material 520 therefore has limited flexibility. The fourth stretch material 520 is used under the medial and lateral midfoot straps, and it extends around the heel of the cycling shoe above the heel counter. The fourth stretch material 520 is also used under the medial and lateral forefoot straps, and another portion of the fourth stretch material 520 surrounds the portion of the third stretch material 515 on top of the toe cap. In alternative embodiments, additional or fewer types of stretch material may be used. In one embodiment, one or more of the stretch materials can be formed from a knit mesh, and one or more of the stretch material can be formed from a stretch material that is not a knit mesh. In other alternative embodiments, the different types of stretch material may be utilized in a different fashion to provide different flexibility and/or breathability to various portions of the cycling shoe.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more".

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A cycling shoe comprising:

a sole;

a heel counter mounted to the sole;

a toe cap mounted to the sole; and a forefoot strap that includes a medial forefoot strap and a lateral forefoot strap;

wherein the medial forefoot strap includes a first portion mounted to the toe cap and a second portion mounted to the sole such that a first metatarsal head relief window is formed, and wherein the first metatarsal head relief window is bordered by an edge of the first portion of the medial forefoot strap, an edge of the second portion of the medial forefoot strap, a portion of the toe cap, and a portion of the sole; and wherein the lateral forefoot strap is mounted to the sole such that a fifth metatarsal head relief window is formed between a distal edge of the lateral forefoot strap and the toe cap.

2. The cycling shoe of claim 1, further comprising a securing system that connects the medial forefoot strap to the lateral forefoot strap.

3. The cycling shoe of claim 1, further comprising a midfoot strap that includes a medial midfoot strap and a lateral midfoot strap.

4. The cycling shoe of claim 3, wherein the lateral midfoot strap is mounted to the heel counter such that a fifth metatarsal tuberosity relief window is formed between the lateral midfoot strap and a proximal edge of the lateral forefoot strap.

5. The cycling shoe of claim 3, wherein the medial midfoot strap includes a first portion and a second portion.

6. The cycling shoe of claim 5, wherein the first portion of the medial midfoot strap is mounted to the heel counter.

7. The cycling shoe of claim 6, wherein the second portion of the medial midfoot strap is mounted to the sole.

8. The cycling shoe of claim 5, wherein the second portion of the medial midfoot strap is connected to the second portion of the medial forefoot strap.

9. The cycling shoe of claim 1, wherein the forefoot strap is composed of four layers.

10. The cycling shoe of claim 9, wherein the four layers comprise a liner layer, a foam layer, a net mesh layer, and a thermoplastic polyurethane (tpu) layer.

11. The cycling shoe of claim 10, wherein a body of the cycling shoe is formed of four different types of stretch material.

12. The cycling shoe of claim 11, wherein the four different types of stretch mesh material include a first mesh having a mesh pattern with first openings, a second mesh having a mesh pattern with second openings that are smaller than the first openings, a third mesh having a mesh pattern with third openings that are smaller than the second openings, and a fourth mesh having a mesh pattern with fourth openings that are smaller than the third openings.

13. The cycling shoe of claim 12, wherein the first mesh covers the first metatarsal head relief window and the fifth metatarsal head relief window.

14. A method for constructing a cycling shoe, the method comprising:

mounting a heel counter to a sole;

mounting a toe cap to the sole; and mounting a forefoot strap that includes a medial forefoot strap and a lateral forefoot strap to the cycling shoe, wherein mounting the forefoot strap comprises:

mounting a first portion of the medial forefoot strap to the toe cap and mounting a second portion of the medial forefoot strap to the sole to form a first metatarsal head relief window that is bordered by an edge of the first portion of the medial forefoot strap, an edge of the second portion of the medial forefoot strap, a portion of the toe cap, and a portion of the sole; and mounting the lateral forefoot strap to the sole to form a fifth metatarsal head relief window between a distal edge of the lateral forefoot strap and the toe cap.

15. The method of claim 14, further comprising forming the forefoot strap from four layers that include a liner layer, a foam layer, a net mesh layer, and a thermoplastic polyurethane (tpu) layer.

16. The method of claim 14, further comprising mounting a midfoot strap that includes a medial midfoot strap and a lateral midfoot strap to the cycling shoe.

17. The method of claim 16, wherein mounting the midfoot strap comprises mounting the lateral midfoot strap to the heel counter to form a fifth metatarsal tuberosity relief window between the lateral midfoot strap and a proximal edge of the lateral forefoot strap.

18. The method of claim 17, wherein mounting the midfoot strap comprises mounting a first portion of the medial midfoot strap to the heel counter and mounting a second portion of the medial midfoot strap to the sole.

19. The method of claim 14, further comprising forming a body of the cycling shoe from four different types of stretch material.

20. The method of claim 19, wherein each of the four different types of stretch material has a distinct amount of stretch.

* * * * *